US008888666B2

(12) United States Patent
Quader

(10) Patent No.: US 8,888,666 B2
(45) Date of Patent: Nov. 18, 2014

(54) STRENGTH TRAINING APPARATUS

(76) Inventor: David Louis Quader, Gambrills, MD (US)

( * ) Notice: Subject to any disclaimer, the term of this patent is extended or adjusted under 35 U.S.C. 154(b) by 639 days.

(21) Appl. No.: 12/967,634

(22) Filed: Dec. 14, 2010

(65) Prior Publication Data

US 2012/0149539 A1 Jun. 14, 2012

(51) Int. Cl.
*A63B 21/08* (2006.01)
*A63B 21/00* (2006.01)

(52) U.S. Cl.
CPC ..... *A63B 21/08* (2013.01); *A63B 21/0004* (2013.01); *A63B 21/1469* (2013.01)
USPC ..... 482/109; 482/121; 482/148

(58) Field of Classification Search
CPC ..... A63B 21/0552; A63B 2009/006; A63B 21/023; A63B 2225/107; A63B 5/11; A63B 2021/1609; A63B 2022/0038; A63B 2022/0041; A63B 2022/185
USPC ..... 482/110, 148, 109; 81/22; 30/308.1; 473/219, 256
See application file for complete search history.

(56) References Cited

U.S. PATENT DOCUMENTS 4,302,008 A * 11/1981 Lard ..... 482/109
4,819,935 A * 4/1989 Dirksing et al. ..... 482/109
5,375,487 A 12/1994 Zimmerman
5,433,438 A 7/1995 Gilman
6,190,292 B1 2/2001 Panes
6,533,685 B1 3/2003 Otten et al.
7,181,994 B2 2/2007 Norton
7,533,430 B2 * 5/2009 Moxey ..... 7/143
7,553,239 B2 6/2009 Pullaro
7,611,449 B2 * 11/2009 Kim ..... 482/110
7,618,328 B2 * 11/2009 Davenport et al. ..... 473/257
7,682,267 B2 * 3/2010 Libonati ..... 473/457
7,922,595 B2 * 4/2011 Libonati ..... 473/224
8,118,693 B2 * 2/2012 Tande ..... 473/457
2003/0094080 A1 5/2003 Whalen et al.
2005/0252345 A1 11/2005 Carmlen et al.
2007/0144016 A1 * 6/2007 Luo ..... 30/308.1
2009/0093348 A1 4/2009 Wang
2010/0137078 A1 6/2010 Liberatore

OTHER PUBLICATIONS

Rod Cross, The Bounce of a Ball, American Journal of Physics, vol. 67, Issue 3, Mar. 1999, pp. 222-227.

* cited by examiner

*Primary Examiner* — Stephen Crow
(74) *Attorney, Agent, or Firm* — Edell, Shapiro & Finnan, LLC

(57) ABSTRACT

An strength training apparatus includes an elastic headpiece and a handle by which to perform, among other exercises, intensive hammer training. Multiple headpieces may be constructed each having distinct characteristics, such as weight and recoil, and may be selectively coupled to the handle. The headpiece is retained on the handle so as to withstand both angular moment and impact force exerted on the apparatus during operation thereof.

18 Claims, 8 Drawing Sheets

STRENGTH TRAINING APPARATUS

BACKGROUND

Weighted clubs, bats, rods and the like have found usefulness in not only sports training, but for general fitness as well. Many of these exercise devices mimic in form the actual equipment that would be used in the corresponding sport. Alternatively, specially designed weights are available to couple to the sports equipment itself. The weight used in such swing exercises is typically small, e.g., less than 2 pounds (0.91 kg). Thus, these exercises, while useful in developing muscle memory, are not suited for intensive fitness training.

Sledgehammer exercises have become a popular choice for intensive fitness training programs. Such exercises involve repeatedly hammering against a resilient surface with a moderately weighted sledgehammer, e.g., 8 lb (3.6 kg). Typically, the resilient surface is a side wall of the large tire, such as a tractor tire. The tire may be placed directly on the ground or supported at an angle with respect thereto so that a target muscle group may be exercised. Whereas these exercises have become a popular way to build strength and stamina, they can only be carried out where a large tire is available. Thus, the need is apparent for a strength training apparatus by which such intensive training may be accomplished without bulky equipment.

SUMMARY

The present general inventive concept provides a strength training apparatus by which intensive strength training may be performed. The invention may be embodied as, among other things, a training hammer by which to conduct intensive core training.

The foregoing and other utility and advantages of the present general inventive concept may be achieved by a strength training apparatus having a handle, an elastic headpiece coupled to the handle at the distal end thereof to recoil upon being struck against a rigid surface, and a centripetal stop at the distal end of the handle to retain the headpiece thereon.

The foregoing and other utility and advantages of the present general inventive concept may also be achieved by a strength training apparatus having an elastic body of a predetermined weight and a bore formed therein. The apparatus may include a rod for lifting the elastic body and a handle for swinging the elastic body against a rigid body. The rod and the handle may be selectively coupled to the elastic body through the bore.

The foregoing and other utility and advantages of the present general inventive concept may also be achieved by a strength training apparatus having a handle, a first elastic headpiece of a first weight and a second elastic headpiece of a second weight. The handle may be selectively coupled to either one of the first headpiece and the second headpiece.

BRIEF DESCRIPTION OF THE DRAWINGS

These and/or other aspects and utilities of the present general inventive concept will become apparent and more readily appreciated from the following description of exemplary embodiments, taken in conjunction with the accompanying drawings, of which.

DETAILED DESCRIPTION

Figure 1:
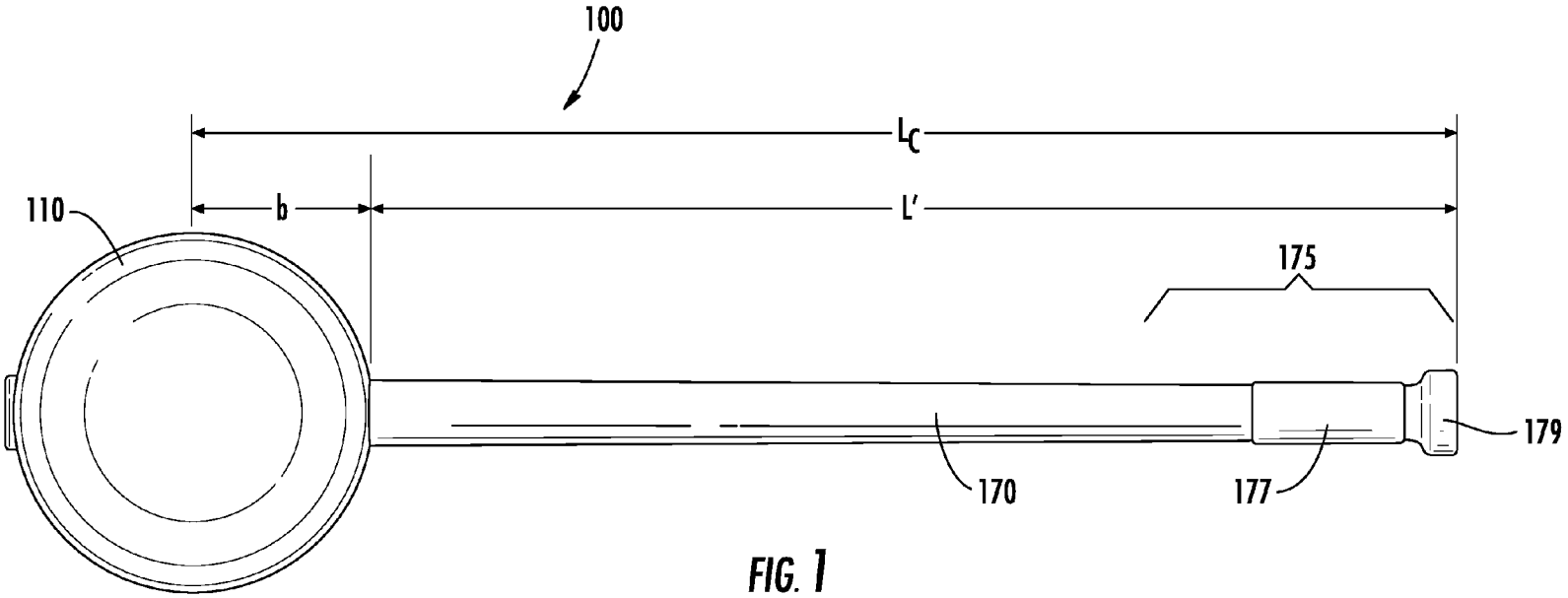
FIG. 1 is an illustration of an exemplary strength training apparatus constructed in accordance with the present general inventive concept.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Referring to FIG. 1, there is illustrated an exemplary strength training apparatus 100 constructed in accordance with the present invention. It is to be understood that while exercises other than intensive hammering exercises may be performed with embodiments of the present invention, strength training apparatus 100 may be alternatively referred to herein as training hammer 100. Moreover, despite the physical configuration of exemplary strength training apparatus 100 illustrated in FIG. 1, the ordinarily skilled artisan will recognize numerous other configurations in which to embody the present invention upon review of this disclosure. The present invention is intended to encompass all such alternatives.

As is illustrated in the FIG. 1, the exemplary training hammer 100 includes a headpiece 110 and a handle 170. In certain embodiments of the present invention, the headpiece 110 is of elastic construction such that a predetermined portion of the kinetic energy prior to a collision with the surface is conserved as kinetic energy in subsequent recoil, while the remaining kinetic energy is converted to internal energy in the training hammer 100. In accordance with the present invention, the elasticity of headpiece 110 may be established by design so as to be appropriate to the intended exercise. In certain exercises, significant recoil of the headpiece 110, e.g., half of the initial velocity or greater, may be desired so that the user, or as referred to herein, the trainee must apply a counteracting force as part of the exercise. In certain other exercises, little to no recoil is desired, e.g., less than a quarter of the initial velocity, such as where, by the nature of the exercise, such recoil may be counterproductive to the training.

The present invention may be embodied with the elasticity suitable to various applications thereof.

The headpiece 110 may further be weighted to a level appropriate to the intended exercise. In typical exercise regimes, the weight of the headpiece may be between 0.907 kg (2 lbs) and 9.072 kg (20 lbs), although the present invention is not so limited. The headpiece 110 may be suitably coupled to the handle 170 in a manner that retains the headpiece 110 thereon as the strength training apparatus 100 is swung. The handle 170 may include a grip 175 by which the strength training apparatus 100 is grasped by the trainee. The grip 175 may include a grasping surface 177 suitably disposed on the handle 170 to provide not only comfort to the trainee, but to provide additional friction between the handle 170 and the hands of the trainee. Additionally, the grip 175 may include a knob 179 to assist the trainee in maintaining the grasp on the strength training apparatus 100 throughout the exercise.

Figure 2C:
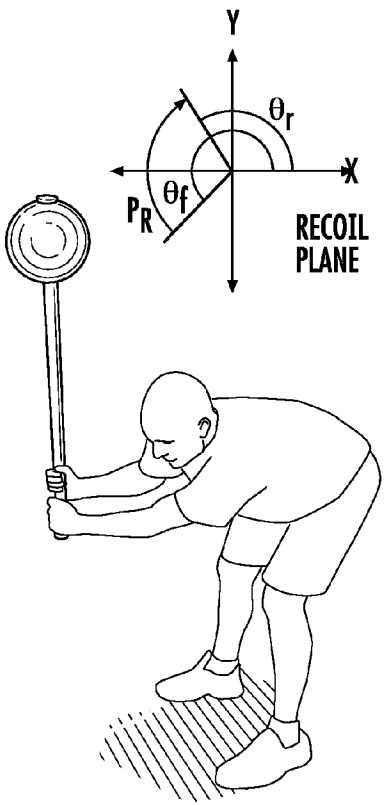
FIGS. 2A-2C is an illustration of an exemplary strength training performed with an strength training apparatus embodied in accordance with the present general inventive concept.
Figure 2B:
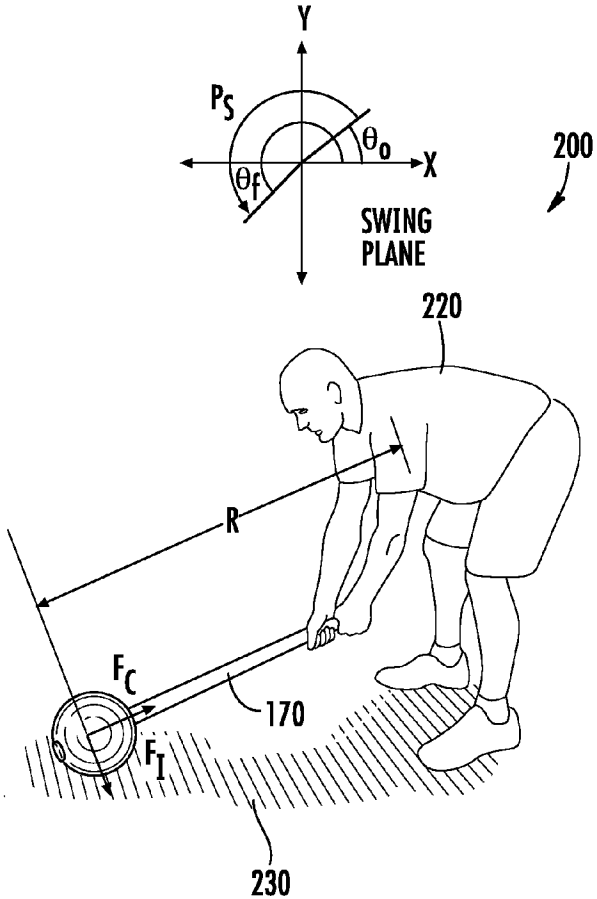
Figure 2A:
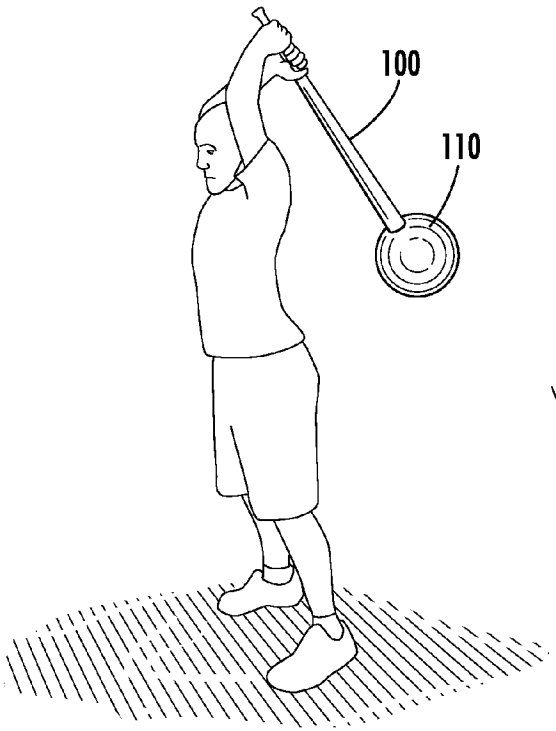

FIGS. 2A-2C illustrate a single repetition 200 of an exemplary exercise by which the trainee may benefit from a strength training apparatus constructed in accordance with the present invention. It is to be understood that the illustrations of FIG. 2A-2C are all of the same system of objects, as described in the paragraphs that follow, over the passage of time from left to right, i.e., from FIG. 2A to FIG. 2C. Accordingly, except where otherwise apparent, reference numerals illustrated in one of the figures is intended to represent the same object in all of the figures, and the reference to FIG. 2 is intended to encompass the principle of operation, as a whole, of the exemplary strength training apparatus 100 depicted in FIGS. 2A-2C.

The exemplary exercise illustrated in FIG. 2 is a core training exercise to develop abdominal muscles, as well as the shoulders and arms. For purposes of description and not limitation, the path $P_S$ of the strength training apparatus 100 when swung by the trainee 220 defines what will be referred to herein as the swing plane and the path $P_R$ defined by the strength training apparatus 100 after the collision with a surface will be referred to as the recoil plane. In certain cases, the swing plane and the recoil plane will reside in a common plane, which may indeed be an objective of the exercise. However, the swing plane and the recoil plane need not coincide, such as when the surface is struck with the strength training apparatus 100 other than perpendicularly thereto. In certain embodiments of the present inventions, the headpiece 110 may be shaped, such as by an appropriately planar surface disposed thereon, to recoil in a different plane than in the swing plane.

To properly perform the exemplary exercise of FIG. 2, the trainee 220 must swing the training hammer 100 against a rigid surface, such as the floor 230, such that the swing plane and the recoil plane are substantially coincident. Further, in the exemplary exercise 200, the trainee 220 must move his upper body out of the recoil plane, alternating sides for each repetition 200. The trainee 220 begins each repetition 200 by lifting the strength training apparatus 100 to the position illustrated in FIG. 2A. The trainee 220 then swings the strength training apparatus 100 in the swing plane, which in this case is vertically, with as much velocity for which he is capable so as to strike the floor 230 with the headpiece 110. FIG. 2B illustrates the completion of such a swing. At this point in the repetition 200, the strength training apparatus 100 recoils vertically at a recoil velocity equal to a fraction of the initial velocity at which the headpiece 110 was travelling prior to impact. The trainee 220 must apply an opposing force on the handle 170 of the strength training apparatus 100 to stop such motion while at the same time moving his upper body to the side corresponding to the current repetition 200. FIG. 2C illustrates the point at which the trainee 220 has brought the strength training apparatus 100 to a stop, thus concluding repetition 200.

The ordinarily skilled artisan will recognize the relatively large forces that may be exerted on the training hammer 100 during an exercise such as that illustrated in FIG. 2. To illustrate these forces, a simple mathematical model will now be described with reference to FIGS. 1 and 2. It is to be understood that the model described below is intended solely to exemplify, in a brief manner, certain relevant forces arising from the operation of various embodiments of the present invention. Certain complexities, such as, for example, the physical mechanics of an actual swing of the training hammer 100 and the exact locations of cooperating elements during different phases of the swing will be simplified and/or ignored in the exemplary model below. It is to be understood that approximations of the magnitude of the basic forces arising from exemplary exercises are described below to the extent that certain beneficial features of embodiments of the present invention may be fully appreciated. More precise mathematical models may be developed and used to, for example, design certain embodiments of the present invention without departing from the spirit and intended scope thereof.

Referring first to FIG. 1, the headpiece 110 of exemplary training hammer 100 may be modeled as a solid elastic sphere of radius b and mass m, the center of mass of which is located a distance $L_S$ from the proximal end of the handle 170. The headpiece 110 is located at the distal end of the handle 170 such that the exposed length of the handle 170 is L', i.e., $L_C$=L'+b. To simplify the model, the mass of the handle 170 will be considered negligible in comparison to that of the headpiece 100 and will be ignored.

Referring now to FIG. 2, it is assumed that the trainee 220 can apply a linearly increasing torque to the training hammer 100, i.e., $\tau=\beta t$, where $\beta$ is a constant torque rate that varies upon, among other things, the fitness of the trainee. As the trainee 220 becomes stronger over time, the applied torque rate $\beta$ may increase and, accordingly, the applied torque to the training hammer 100. Additionally, $$\tau = I\frac{d^2\theta(t)}{dt^2} = \beta t \Rightarrow \frac{d^2\theta(t)}{dt^2} = \frac{\beta}{I}t, \tag{1}$$

where I is the moment of inertia of the training hammer 100 and $\theta(t)$ is the instantaneous angular position of the headpiece 110 in the swing plane. For simplification, the effects of gravity will be considered negligible in comparison to the force exerted by the trainee 220 and will be ignored. Equation (1) is a second order differential equation that, when solved for the boundary conditions $\theta(t=0)=\theta_0$ and $v(t=0)=0$ provides an approximation of the instantaneous angular orientation of the training hammer 100 in the swing plane:

$$\theta(t) = \frac{\beta}{I}\frac{t^3}{6} + \theta_0, \tag{2}$$

where $\theta_0$ is the initial angular position of the headpiece 110 in the swing plane. Taking the final angular position of the headpiece 110 at the onset of impact as $\theta_f$ occurring at $t=t_f$, the total swing time to impact may be approximated by, $$t_f = \sqrt[3]{\frac{6I}{\beta}(\theta_f - \theta_0)}\,. \tag{3}$$

The linear velocity of the headpiece 110 at the moment of impact with a rigid surface 230 may thus be approximated by, $$v_f = R\frac{d\theta}{dt}\Big|_{t=t_f} = \frac{R\beta t_f^2}{2I}, \tag{4}$$

where $t_f$ is given by Equation (3), $R=L_C+\alpha$, and a is the length of the contributing portion of the trainee's arm. For simplification, it will be assumed that a, and thereby R is constant, although typically a will vary with time in a complex manner as the trainee 220 bends and extends his/her arm during the swing of training hammer 100.

The force on the headpiece 110 resulting from the impact with the rigid surface 230 is given by, $$F_I = m_h\frac{dv}{dt} \cong m_h\frac{\Delta v}{\Delta t}, \tag{5}$$

where $m_h$ is the mass of the headpiece 110, $\Delta v$ is the change in velocity from $v_f$ to v=0, and $\Delta t$ is the time over which the velocity changes from $v_f$ to v=0. For an elastic sphere, the time over which the headpiece 110 comes to a stop is estimated as, $$t_\Delta = \frac{\pi}{2}\sqrt{\frac{m_h}{k_h}}, \tag{6}$$

where $k_h$ is the elastic stiffness of the headpiece 110 (see, for example, *The Bounce of a Ball*, Rod Cross, *Am. J. Phys.* 67 (3), March 1999). It is to be emphasized that $t_\Delta$ in Equation (6) is an approximation for an elastic sphere and such time constant will vary according to the geometry of and material used in the actual construction of the headpiece 110. Moreover, $t_\Delta$ of Equation (6) is that of a dropped ball and may not reflect the complex vibrations and deformations in the headpiece 110 resulting from a higher velocity collision. Combining Equations (5) and (6), $$F_I \cong m_h\frac{v_f}{t_\Delta}. \tag{7}$$

The linear force $F_I$ is exerted during the collision, but, as illustrated in FIG. 2, there is also a centripetal force $F_C$ acting on the headpiece 110 and handle 170 during the swing of training hammer 100. The centripetal force $F_C$ acting on the training hammer 100 just before impact may be estimated by, $$F_C = m_h\frac{v_f^2}{R}, \tag{8}$$

and is applied by the handle 170, the coupling mechanism between the handle 170 and the headpiece 100, and the grasp on the handle 170 by the trainee 220 against the angular momentum of the swung headpiece 110.

Figure 8A:
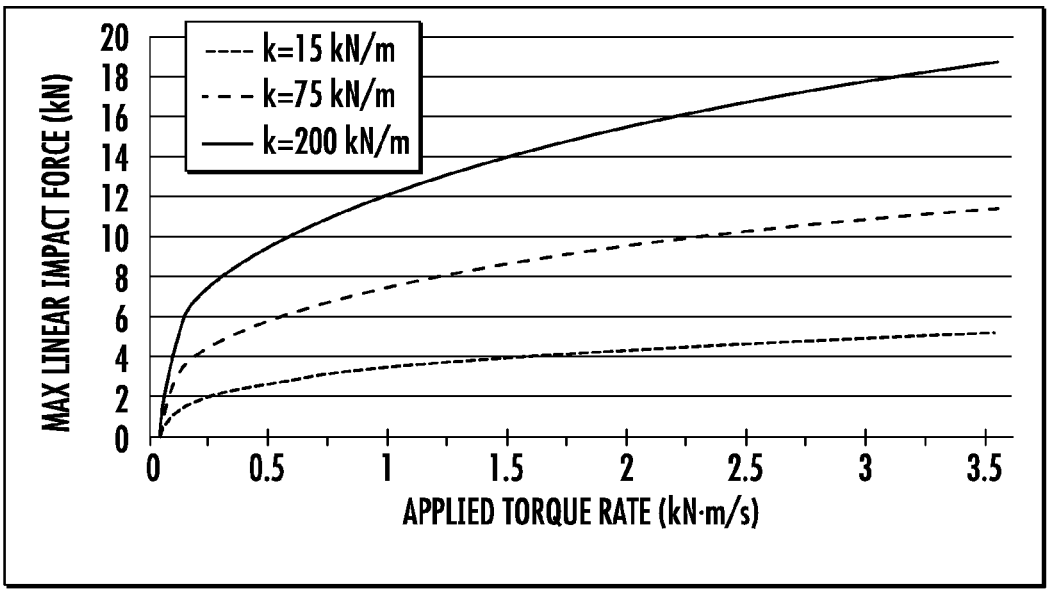
FIGS. 8A-8B are graphs illustrating forces acting on certain embodiments of the present general inventive concept during use.
Figure 8B:
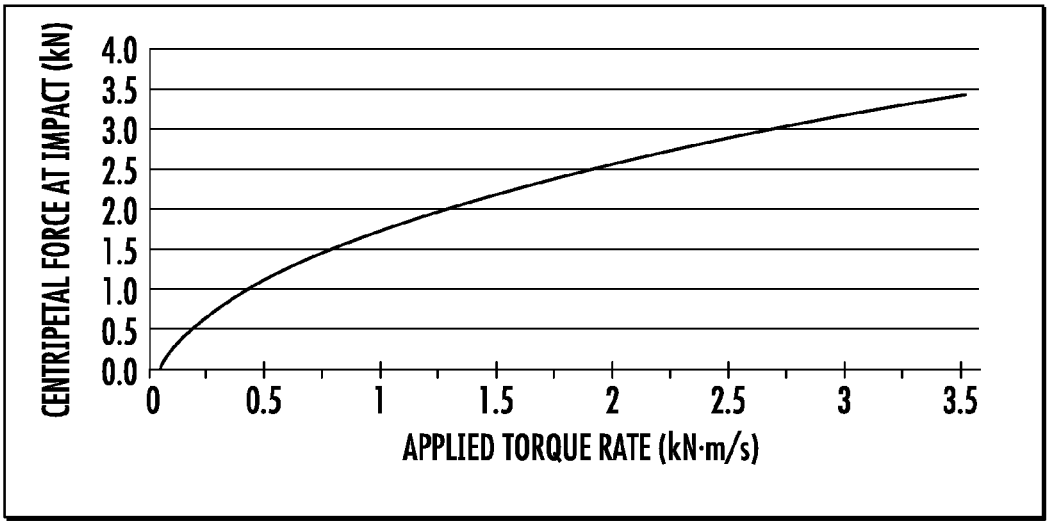

FIGS. 8A-8B graphically depict the forces estimated by Equations (7) and (8) for a solid spherical headpiece of radius b=0.12 m (4.7 in) and mass $m_h$=5.0 kg (11 lbs). The length of the exemplary moment arm is R=1.25 m (49.2 in) and the angle $\theta_f-\theta_0$ subtended by the headpiece 110 through the swing is 145°. The forces $F_I$ and $F_C$ are graphed over a range of the applied torque rate constant $\beta$, which is indicative of the swing strength of the trainee 220. It is to be observed from the graphs that the force $F_I$ illustrated in FIG. 8A increases with an increase in the stiffness $k_h$ and is transferred to the handle 170 and to the grip 175, thereby affecting the trainee's grasp on the training hammer 100. At the same time, training hammer 100 is being pulled away from the trainee 220 by a force equal to the centripetal force $F_C$ illustrated in FIG. 8B.

Taking a numerical example from the graphs of FIGS. 8A-8B, it is to be assumed that the trainee is capable of applying torque to the exemplary training hammer at a linear rate of $\beta$=1.2 kN·m/s (885.0×$10^3$ lb·ft/s), the final velocity at impact would be $v_f$=20.5 m/s (45.9 mph). The peak impact force $F_I$ of a headpiece 110 with stiffness $k_h$=75.0 kN/m (131.8×$10^6$ lb/in, slightly stiffer than a superball) would be $F_I$=8.0 kN (1800 lb·f, approximately the impact force of the same headpiece 110 being dropped from a seven (7) story building). At the same time, the centripetal force $F_C$ exerted on the headpiece 110 by the handle 170, the coupling of the headpiece 110 therewith, and the trainee's grasp thereon would be $F_C$=1.7 kN (377.7 lb·f, approximately equivalent to the pull of a 5-man tug-of-war team). Accordingly, embodiments of the present invention include features that take not only these forces into consideration, but in consideration of the repetitive nature of the exercises in which these forces are generated as well.

As discussed above, the centripetal force $F_C$ is achieved through both the grasp on the handle 170 by the trainee 220 and through the coupling of the headpiece 110 with the handle 170. Accordingly, in certain embodiments of the present invention, the grip of the handle 170 is constructed to ensure that the trainee 220 can maintain a firm grasp on the handle, such as through grasping surface 177 and knob 179 illustrated in FIG. 1. Additionally, embodiments of the present invention may include a coupling mechanism between the handle 170 and the headpiece 110 to maintain the coupling therebetween over the duration of the intended exercise, i.e., to maintain the centripetal force $F_C$ during the swing and, immediately thereafter, to retain the headpiece 110 on the handle 170 during impact. Moreover, embodiments of the coupling mechanism constructed in accordance with the present invention should maintain such coupling over a suitable number of repeated swings and impacts.

Embodiments of the present invention may be constructed to return a predetermined portion of the initial kinetic energy applied by a trainee, i.e., the kinetic energy immediately prior to impact with a rigid surface, as recoil to facilitate the performance of certain exercises. The amount of kinetic energy lost to the training hammer 100, and therefore unavailable for recoil, may be quantized by the coefficient of restitution (COR) of the training hammer 100, denoted herein as e and given by $e=v_2/v_1$, where $v_1$ is the velocity of the headpiece 110 immediately prior to colliding with the surface 230 and $v_2$ is the recoil velocity of the headpiece 110 after the collision. The COR e falls in [0,1], where e=0 indicates a completely inelastic collision, i.e., would have no recoil, and e=1 indicates a completely elastic collision. The present invention may be embodied to have a target recoil velocity $v_2$ that is a predetermined fraction of the initial velocity $v_1$ by the relationship $v_2=v_1 \cdot e^2$. A particular COR may be established in embodiments of the present invention through a combination of materials and structure that results in a desired conversion of kinetic energy into potential energy during impact and the subsequent conversion of potential energy (minus the energy dissipated in the collision) back into kinetic energy in the recoil. Such may be achieved by prudent selection of, among other things, the mass of the headpiece as well as that of the handle, the stiffness of the headpiece as well as that of the handle, the length of the handle, the shape and size of the headpiece as well as its internal structure, and the interaction between these variables. It will be readily recognized by the ordinarily skilled artisan that numerous combinations of these and other design parameters can result in multiple configurations all providing the same recoil velocity. Additionally, configuring an embodiment of the present invention to establish a known amount of recoil, given the numerous variables discussed above, may require intensive calculations, such as, for example, through a suitable mathematical model, including computer models. The present invention is not limited to a particular design methodology.

Figure 3:
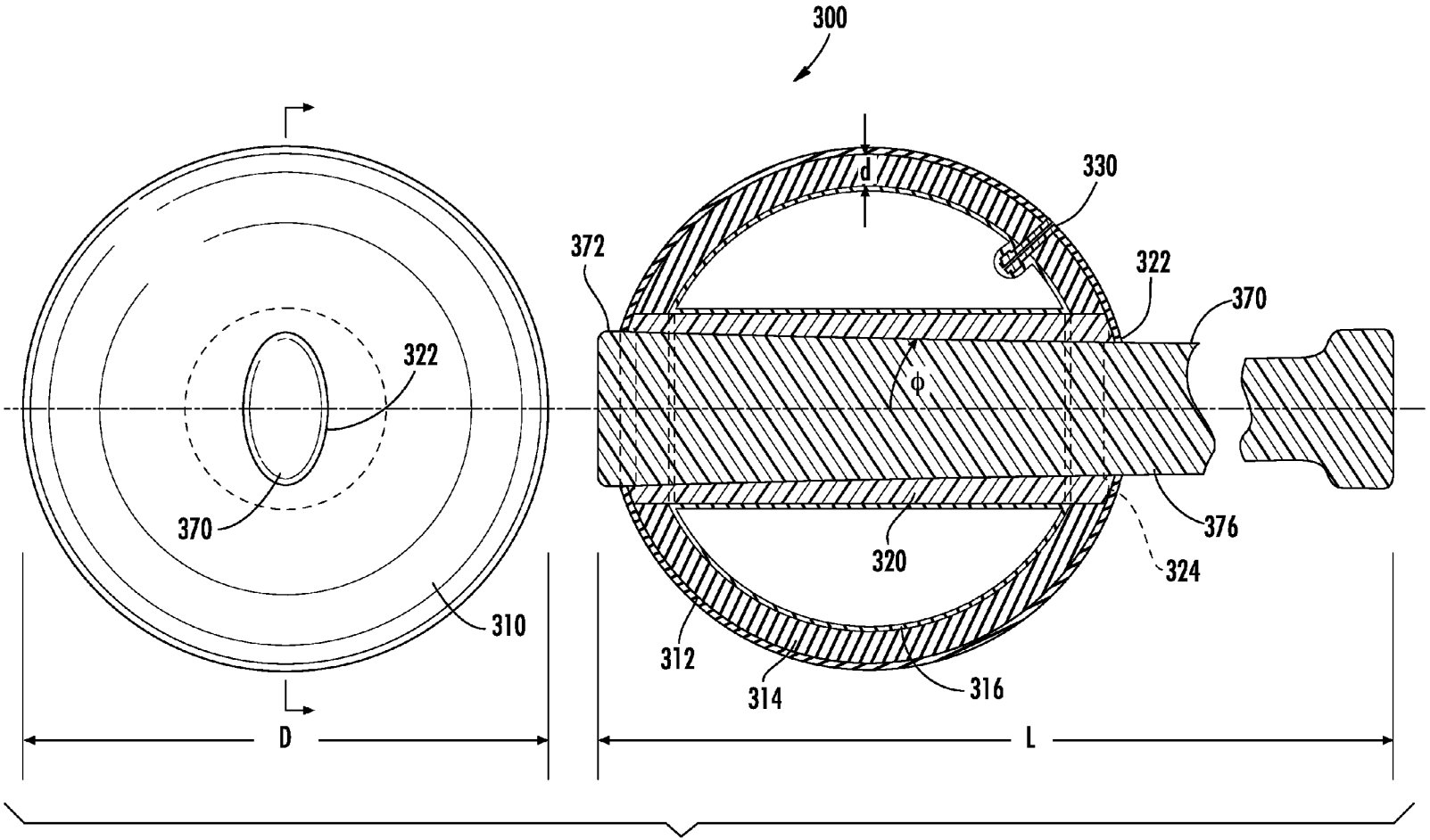
FIG. 3 is an illustration of an exemplary strength training apparatus constructed in accordance with the present general inventive concept.

Referring to FIG. 3, there is illustrated an exemplary training hammer 300 constructed in accordance with the present invention. As is illustrated in the figure, exemplary training hammer 300 includes a headpiece 310 and a handle 370. In the illustrated embodiment, the headpiece 310 is spherical having a diameter D. The exemplary training hammer 300 has an overall length L. It is to be understood that the diameter D and the length L are design parameters of embodiments of the present invention and may be set on an application basis, such as in accordance with an intended exercise.

In certain embodiments of the present invention, the handle 370 may have a cross-sectional profile that provides comfort to the trainee in accordance with the type of exercise being performed. Additionally, cross-sectional profile of the handle 370 may be of a certain shape to correspond with particular sports equipment, such as a bat, so as to develop muscle memory. The exemplary handle 370 has a substantially oval cross-sectional profile, although it is to be understood that the present invention is not so limited.

Exemplary headpiece 310 includes an outer shell 312 formed of a suitable elastic material such as rubber. The headpiece 310 may further include an air bladder 316 internal to the outer shell 312 with which to inflate the headpiece 310 to a predetermined stiffness. A bladder valve 330 may be suitably disposed through the outer shell 310 and into the air bladder 316 through which the air bladder 316 may be pressurized.

The exemplary training hammer 300 includes a bore 322 in the headpiece 310 through which the handle 370 may be received. As is illustrated in FIG. 3, the bore 322 may be formed as frustoconical hole through the headpiece 310 having sides sloped at an angle $\phi$ with the axis thereof. Additionally, the bore 322 may be in coaxial alignment with the headpiece 310, although it is to be understood that the present invention is not so limited. The handle 370 may include a shoulder 376 having a shape complementary to that of the bore 322, i.e., having sides sloped at an angle $\phi$ with the axis thereof. The headpiece 310 may be coupled to the handle 370 by inserting the proximal end of the handle through the bore 322 until the shoulder 376 engages the bore 322. The force of the swung headpiece 310 impels the bore 322 against the shoulder 376 thereby retaining the headpiece 310 on the handle 370 through the swing. The shoulder 376 limits the outward motion of the headpiece 310 on the handle 370 and, as such, the shoulder 372 forms what will be referred to herein as a centripetal stop 372. The shoulder 376 and the bore 322 may be suitably constructed of materials by which the coupling between headpiece 310 and handle 370 is maintained given the weight and anticipated velocity of the headpiece 310.

In certain embodiments of the present invention, the bore 322 is formed in a barrel 320 axially disposed in the headpiece 310. The barrel 320 may be constructed in a variety of materials and thicknesses per the requirements of the particular implementation. For example, the barrel 320 may be constructed from an elastomer to meet elasticity and COR requirements or to allow a certain freedom of movement along the longitudinal axis of the training hammer 300 during the swing thereof. The angle $\phi$ may be increased or decreased in accordance with the desired amount of longitudinal travel; however, due precaution should be taken to avoid excessive deformation that would result in the barrel 320 sliding past the distal end of the shoulder 376. Such allowances for deformation of the headpiece 310 may be used in conjunction with other factors to establish the COR of the training hammer 300. Alternatively, barrel 320 may be formed of a rigid material, such as metal, plastic or wood to prevent such longitudinal deformation of the headpiece 310.

The exemplary barrel 320 is a right-cylindrical structure having frustoconical bore 322 formed therein. The present invention is not limited to a particular shape of barrel 320; however the right-cylindrical shape of the barrel 320 may simplify the manufacture of the headpiece 310. For example, a cylindrical barrel may more easily accommodate a toroidal air bladder 316, which may be less difficult to assemble than a headpiece with a more complexly-shaped air bladder 316.

To withstand repeated impact, the seams between constituent elements of the headpiece 310, such as is representatively illustrated at seam 324, may be of suitable high-strength construction, such as through an adhesive and/or an application of heat and pressure. The ordinarily skilled artisan will recognize numerous elastic body construction techniques that can be used in conjunction with the present invention without departing from the spirit and intended scope thereof.

Headpiece 310 may be weighted by a layer of material 314 disposed within the shell 312. The weight material 314 may be a resilient material, such as rubber, and may be disposed in a substantially uniform thickness d on the inner surface of the outer shell 312. The density of the weight material 312 and the thickness d thereof may be used as the primary source of weight in the headpiece 310. A thicker distribution of weight material 314 may increase not only the weight of headpiece 310, but also the strength to withstand repeated high-velocity impact forces. However, such thickness may increase the stiffness of the headpiece 310 as well and if such stiffness undesirable, the weight of headpiece 310 may be achieved by adding weight to the barrel 320 rather than a thick weight layer 314. In heavier embodiments of the present invention, a moderately thick weight layer 314 may be used to reinforce the outer shell 312 while a weighted barrel 320 may be used to add weight to meet the target weight of the headpiece 310.

Figure 4:
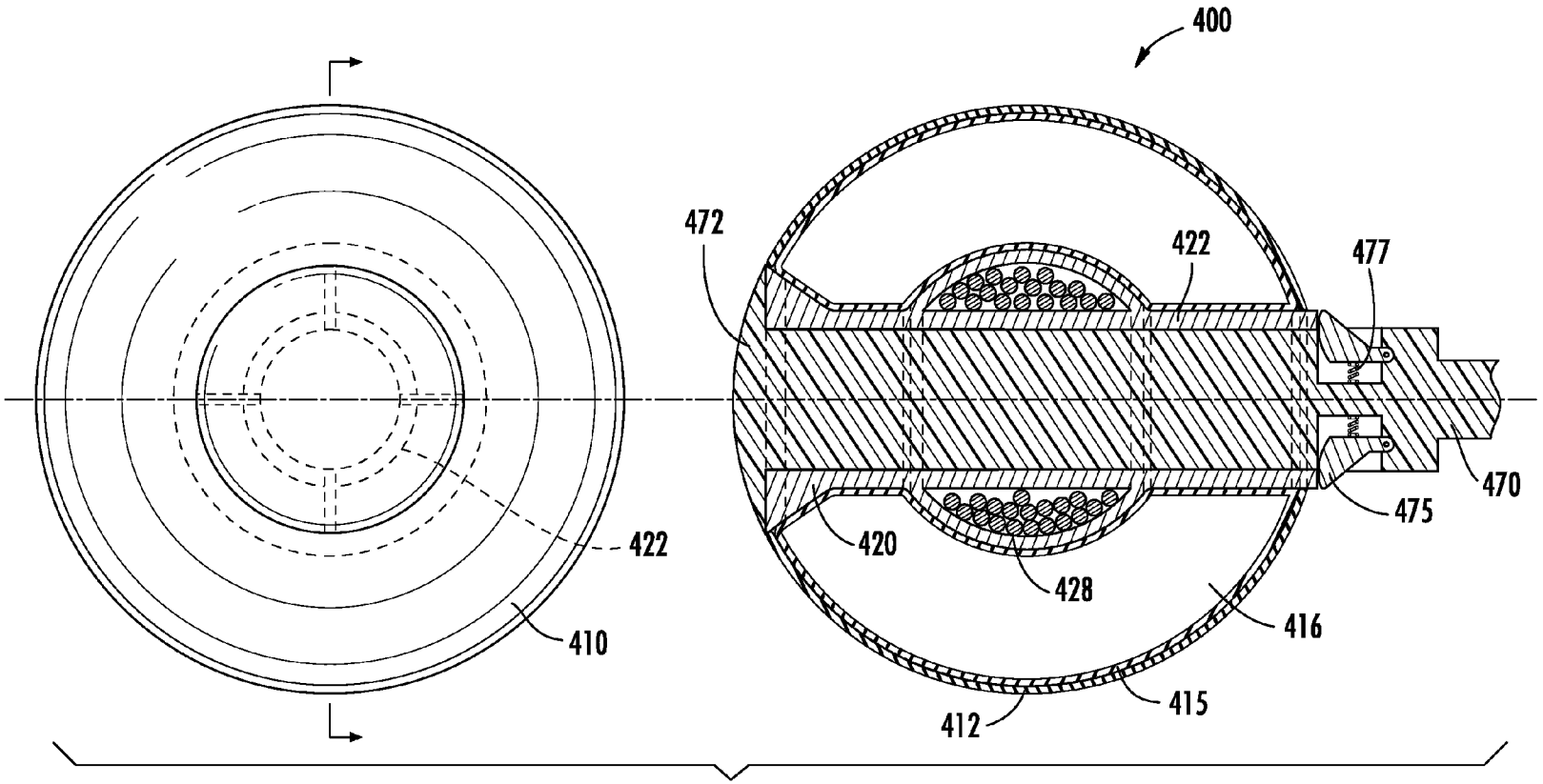
FIG. 4 is an illustration of another exemplary strength training apparatus constructed in accordance with the present general inventive concept.

Referring to FIG. 4, there is illustrated another exemplary training hammer 400 constructed in accordance with the principles of the present invention. The exemplary training hammer 400 includes similar components as those previously described, and detailed description of such components, where apparent, will not be repeated.

Exemplary training hammer 400 includes a headpiece 410 and a handle 470, each of which may be dimensioned in accordance with the intended exercise. The headpiece 410 includes an outer shell 412, an air bladder 416 and a barrel 420. The headpiece end of the exemplary handle 470 is formed as a right cylinder having a circular cross-sectional profile of substantially like radius as that of complementary bore 422 formed in barrel 420. The handle 470 may also include a centripetal stop 472 against which the bore 420 is impelled during the swing of training hammer 400. Additionally, the handle 470 may include one or more detents 477, which may be biased outward by biasing elements, such as springs 477. The detents 475 may prevent the headpiece 410 from sliding down the handle 470 by its weight while the training hammer 400 is being lifted. It is to be understood that slip prevention mechanisms other than the illustrated detents 475 may be embodied in the present invention without deviating from the spirit and intended scope thereof. Additionally, the present invention is not limited to the number of such detents 477. However, a distributed detent scheme such as that illustrated in FIG. 4 may eliminate the possibility of releasing the headpiece 410 as a result of impact, as may occur if a single detent 475 were used.

It is to be noted from FIG. 4 that the detents 475 are positioned and constructed to prevent the headpiece 410 from sliding towards the proximal end of the handle 470 and do not have a role in retaining the headpiece 410 as it is forced towards the distal end of the handle 470. As described above, large forces acting in multiple directions may prohibit spring-loaded mechanisms from functioning as a centripetal stop. Nevertheless, in certain embodiments of the present invention, a set of detents, such as those illustrated as detents 477, may be implemented as a centripetal stop at the distal end of the handle 470.

In the exemplary embodiment 400 illustrated in FIG. 4, the weight material is centrally disposed about the barrel 420 between the bladder 416 and the bore 422. The barrel 420 may include one or more chambers 428 in which weight material, such as lead shot, can be contained. Alternatively, the weight may be provided by thickening one or more portions of the barrel 420, thereby adding the weight of the extra material to the headpiece 410.

The training hammer 400 may implement a thinner outer shell 412 than that described with reference to FIG. 3. Additionally, the headpiece 410 may exclude an additional weight layer between bladder 416 and the outer shell 412, as was the case in the embodiment of FIG. 3. To provide additional strength, headpiece 410 may include a reinforcing layer 415, such as a metal or plastic mesh on the inner surface of, or embedded within the outer shell 412.

Figure 5:
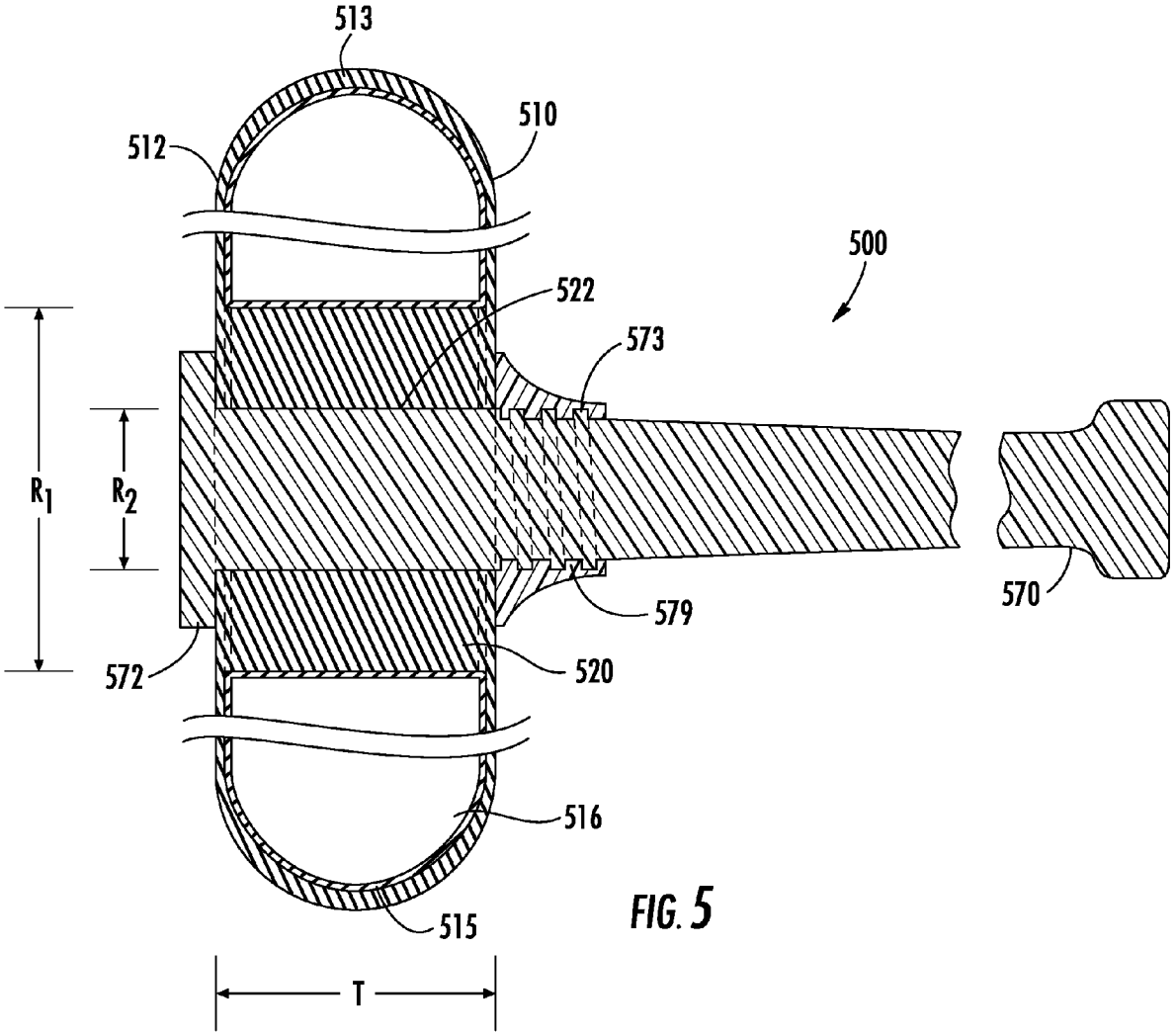
FIG. 5 is an illustration of another exemplary strength training apparatus constructed in accordance with the present general inventive concept.

In FIG. 5, there is illustrated further embodiment 500 of the present invention. Exemplary strength training apparatus 500 includes a headpiece 510 and a handle 570. The exemplary headpiece 510 includes a substantially disc shaped outer shell 512 and may include a reinforcing layer 515 as previously described. The headpiece 510 may include a bladder 516 to provide resilience and stiffness appropriate to the intended exercise. Additionally, the periphery of the outer shell 516 may include additional shell material 513 to, among other things, reinforce the striking edge of the headpiece 510.

A barrel 520 may be axially disposed in the headpiece 510 and may have a central bore 522 formed therein. The barrel 520 may be toroidal having a thickness T, and outer radius $R_1$ and inner radius $R_2$ corresponding to the diameter of the bore 522. The barrel 520 may be sized and formed of material to weight the headpiece 510 in accordance with one or more intended exercises. For example, the exemplary strength training apparatus 500 may be used as a training hammer by coupling the headpiece 510 to the handle 570 between centripetal stop 572 and collar 576. The shaft of handle 570 may have complementary threads 573 formed thereon to lock the headpiece 510 in place and to allow interchanging of headpieces 510. The bore 522 may be of a standard size, such as 50 mm, to accommodate alternative equipment, such as a barbell. A plurality of headpieces 510 may be constructed to have varying weight, and such a headpiece 510 may be used alternately as a training hammer headpiece or as a barbell weight. Other multipurpose configurations may be embodied by the present invention, as will be recognized by the skilled artisan, without departing from the spirit and intended scope thereof.

Figure 6:
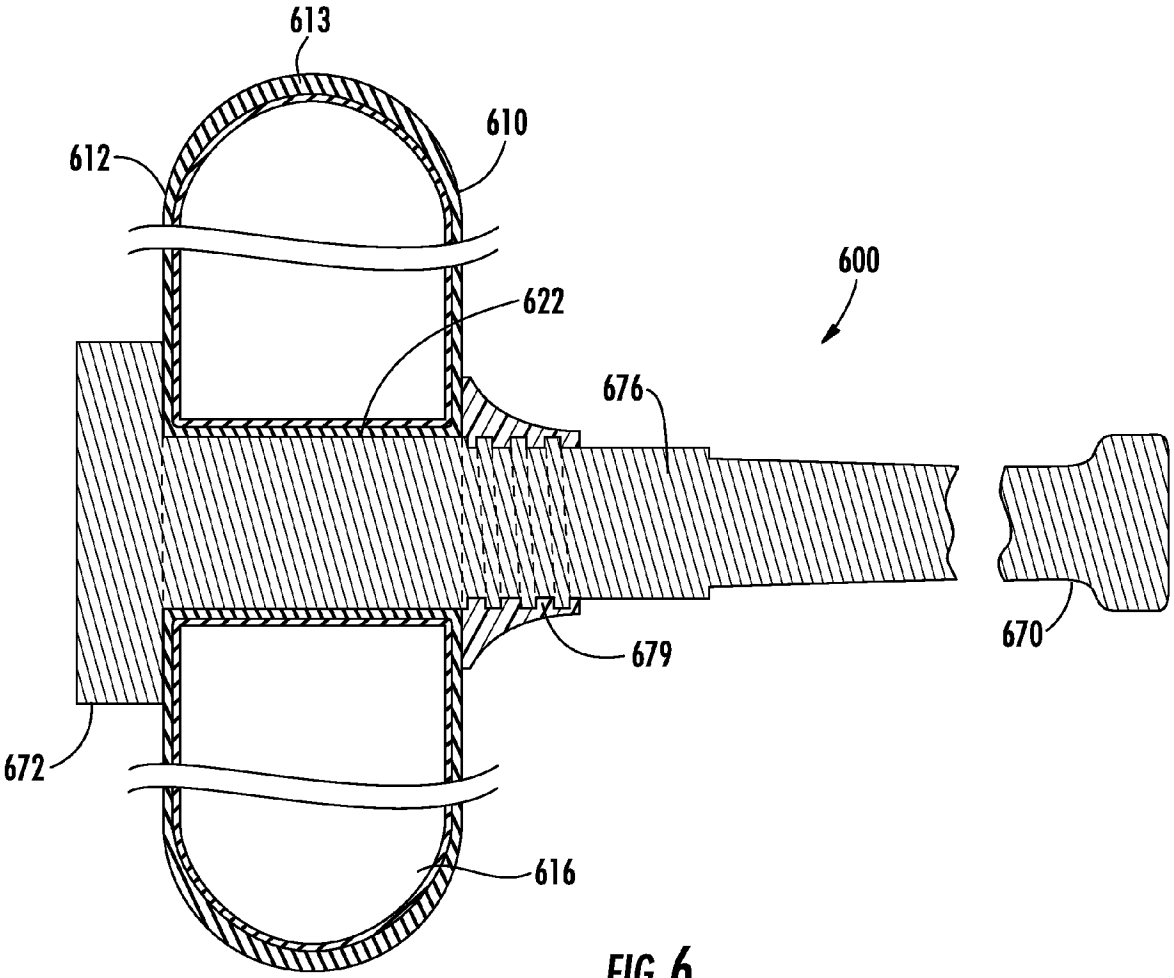
FIG. 6 is an illustration of another exemplary strength training apparatus constructed in accordance with the present general inventive concept.

Referring now to FIG. 6, there is illustrated a further embodiment 600 of the present invention. As in the previous embodiments, strength training apparatus 600 includes a headpiece 610 and a handle 670. The headpiece 610 includes an outer shell 612 and may include an air bladder 616. The outer shell 612 may have a bore 622 formed therein in complementary shape to a shaft 676 of the handle 670.

In the exemplary embodiment 600 of FIG. 6, the headpiece 612 may not be substantially weighted, that is t may be weighted only by the materials required to implement the stiffness and COR of the strength training apparatus. The primary weight material in strength training apparatus 600 is provided on the distal end of the handle 670, such as by an extended centripetal stop 672. A plurality of headpieces 610 may afford the trainee a variety of recoil characteristics, such as by altering the size, stiffness and/or COR over a collection of headpieces. The headpiece 610 may be secured to the handle 670 between the stop 672 and a retaining device, such as threaded collar 679.

Figure 7:
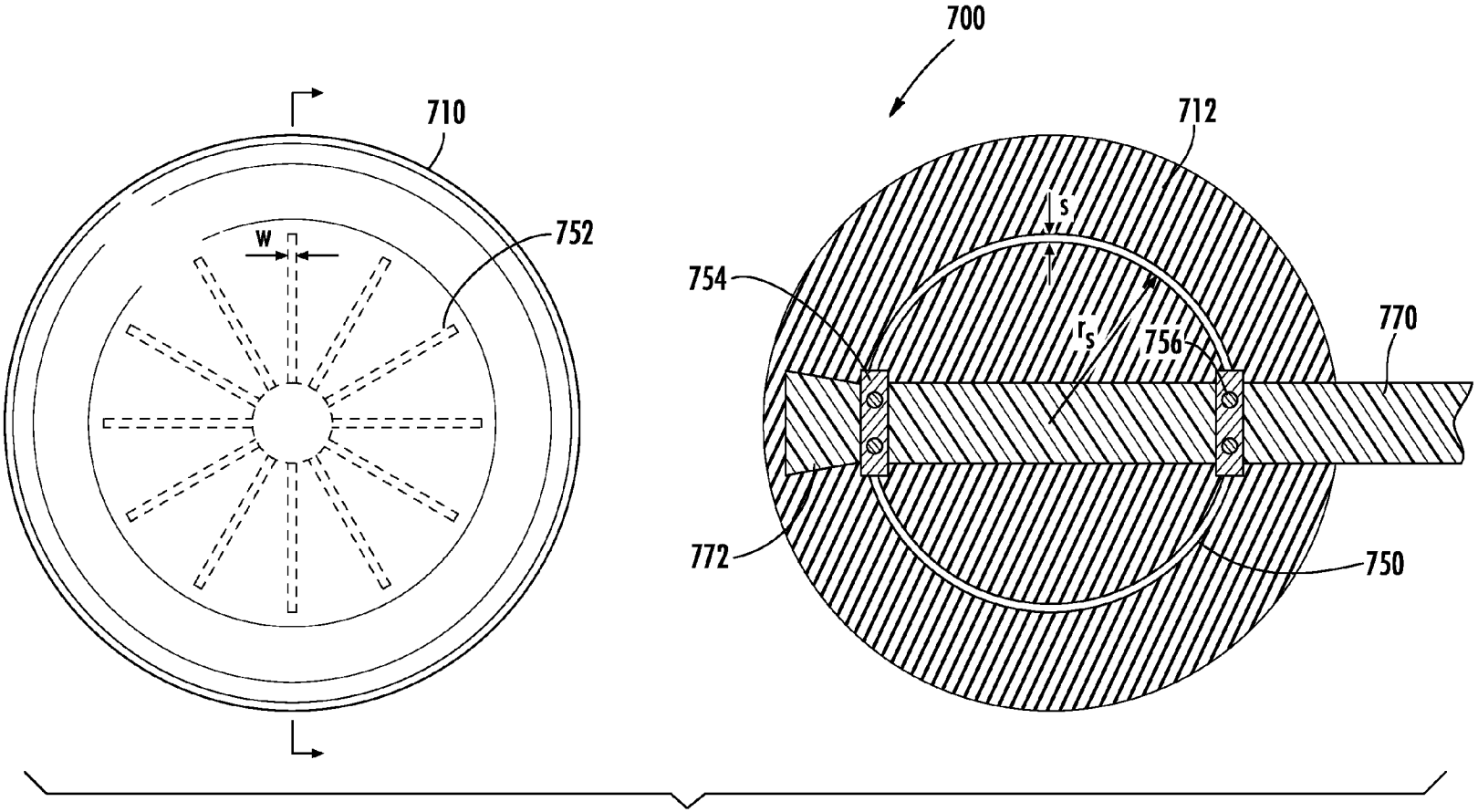
FIG. 7 is an illustration of another exemplary strength training apparatus constructed in accordance with the present general inventive concept.

FIG. 7 illustrates a further exemplary training hammer 700 configured in accordance with the present invention. The exemplary training hammer 700 includes a handle 770 and a solid elastomeric headpiece 710 formed from a suitable elastic material 712 such as, for example, micro-cellular polyurethane. The headpiece 710 may be formed on a frame 750, such as by a suitable molding process. The frame 750 may include a plurality of struts 752 axially extending from one or more hubs 754 fastened to the handle 770 by one or more fasteners 756. The exemplary struts 752 may be semicircular structures, as illustrated in FIG. 7, spanning a pair of hubs 754 within the headpiece 710. The struts 752 may be suitably sized, such as by defining an appropriate width w, thickness s and radius $r_s$, to augment the stiffness $k_h$ of the headpiece 710.

Handle 770 may include a centripetal stop 772 at the distal end thereof to, among other things, assist in retaining the headpiece 770 on the training hammer 700. In certain embodiments of the present invention, the fasteners 756 are omitted so that the hubs 754 are free to move with respect to the handle 770. Accordingly, the frame 750 is allowed greater freedom to deform upon impact. When so embodied, the frame 750 may be retained on the handle 770 by the centripetal stop 772. In other embodiments, the centripetal stop may be implemented by a coupling mechanism between the frame 750 and the handle 770, such as by the fasteners 756.

The present invention may be embodied so as to be manufactured, marketed, sold and used as a multi-component strength training set. For example, a set may include a single handle, such as those described above and a plurality of headpieces that can be selectively coupled to the handle, each headpiece having distinct characteristics, such as varying size, weight, stiffness and COR. As another example, a set may include a handle, a barbell and a plurality of elastic weights, such as is illustrated by headpiece 510 in FIG. 5. Numerous other combinations are possible, and the scope of the present invention is intended to embrace all such combinations and variations.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. A strength training apparatus comprising:

an elastic headpiece constructed to recoil in response to being struck against a rigid surface;

a handle mechanically coupled to the headpiece such that the recoil of the headpiece is transferred to the handle; and a centripetal stop at the distal end of the handle and disposed interior to the headpiece so as to couple the handle thereto and retain the headpiece thereon.

2. The apparatus as recited in claim 1, further comprising:

a bore formed in the headpiece to receive the handle therein, wherein the centripetal stop engages with the distal end of the bore.

3. The apparatus as recited in claim 2, wherein the centripetal stop comprises a shoulder formed at the distal end of the handle and in complementary formation with the bore.

4. The apparatus as recited in claim 2, wherein the bore is a right cylindrical hole formed through the headpiece, the centripetal stop having a diameter greater than the bore and formed in unitary construction with the handle at the distal end thereof.

5. The apparatus as recited in claim 1, wherein the handle includes a frame coupled to the handle and axially extending into the headpiece in addition to the centripetal stop.

6. The apparatus as recited in claim 5, wherein the headpiece is a solid elastic mass formed on the frame.

7. The apparatus as recited in claim 1, wherein the headpiece is a solid elastic mass formed around the centripetal stop.

8. The apparatus as recited in claim 6, where the centripetal stop includes an end stop terminating the distal end of the handle to engage with the frame.

9. A strength training apparatus for performing an exercise in which the apparatus is swung to impact a rigid surface external to the apparatus, the apparatus comprising:

an elastic headpiece constructed to meet a preselected coefficient of restitution of at least 0.25 and to recoil away from the rigid surface in response to the impact of the headpiece with the rigid surface;

a handle mechanically coupled to the headpiece;

a centripetal stop at a distal end of the handle and engaging the headpiece to prevent the headpiece from decoupling from the handle as the strength training apparatus is swung and as the headpiece is struck against the rigid surface.

10. The apparatus as recited in claim 9, wherein the centripetal stop terminates the distal end of the handle.

11. The apparatus as recited in claim 9, wherein the distal end of the handle is weighted by the headpiece to at least 3 pounds.

12. The strength training apparatus as recited in claim 9, wherein the headpiece is constructed to meet the coefficient of restitution of at least 0.5.

13. A strength training apparatus for performing an exercise in which the apparatus is swung to impact a rigid surface external to the apparatus, the apparatus comprising:

a headpiece constructed from an elastic material in a structure that compels the headpiece to recoil away from the rigid surface at a non-zero recoil velocity in response to the impact thereof with the rigid surface at an impact velocity, the ratio of the recoil velocity to the impact velocity being established by a preselected coefficient of restitution of at least 0.25 in accordance with which the elastic material and structure of the headpiece are selected; and an elongate handle weighted at a distal end thereof to no less than three (3) pounds, the handle having a grip at a proximal end thereof at which the handle is grasped by a user, the handle and the headpiece being mechanically coupled one to another such that the headpiece is retained on the handle against radial force imparted to the headpiece by torque applied to the handle by the user to strike the headpiece against the rigid surface and by the torque applied to the handle by the recoil.

14. The strength training apparatus of claim 13, wherein the weight at the distal end of the handle is fulfilled by the weight of the elastic material and the structure of the headpiece.

15. The strength training apparatus of claim 13, wherein the weight at the distal end of the handle is fulfilled by a combination of the weight of the headpiece established by the elastic material and the structure thereof and additional weight mechanically attached to the handle.

16. The strength training apparatus of claim 13, wherein the coefficient of restitution is preselected to at least 0.5.

17. The strength training apparatus of claim 13, wherein the headpiece is a solid elastic body mechanically coupled to the handle.

18. The strength training apparatus of claim 17, wherein the material of the solid elastic body is micro-cellular polyurethane.

* * * * *